US007381473B2

(12) United States Patent
Westin

(10) Patent No.: US 7,381,473 B2
(45) Date of Patent: Jun. 3, 2008

(54) FURAN POLYMER IMPREGNATED WOOD

(75) Inventor: Mats Westin, Stockholm (SE)

(73) Assignee: Kebony ASA, Oslo (NO)

( * ) Notice: Subject to any disclaimer, the term of this patent is extended or adjusted under 35 U.S.C. 154(b) by 0 days.

(21) Appl. No.: 10/522,133

(22) PCT Filed: Jul. 17, 2003

(86) PCT No.: PCT/NO03/00248

§ 371 (c)(1),
(2), (4) Date: Feb. 15, 2005

(87) PCT Pub. No.: WO2004/011216

PCT Pub. Date: Feb. 5, 2004

(65) Prior Publication Data

US 2005/0170165 A1 Aug. 4, 2005

(30) Foreign Application Priority Data

Jul. 26, 2002 (NO) ..... 20023593

(51) Int. Cl.
*B27K 3/15* (2006.01)
*B27K 3/34* (2006.01)

(52) U.S. Cl. ..... 428/528; 428/532; 428/535; 428/537.1; 427/393; 427/440; 524/13; 524/47

(58) Field of Classification Search ..... 428/528, 428/532, 535, 537.1; 427/383, 440; 524/47, 524/440

See application file for complete search history.

(56) References Cited

U.S. PATENT DOCUMENTS

| | | | | |
|---|---|---|---|---|
| 2,909,450 A | | 10/1959 | Goldstein | |
| 7,008,984 B2 | * | 3/2006 | Schneider | 524/13 |

FOREIGN PATENT DOCUMENTS

| | | | |
|---|---|---|---|
| EP | 747183 | | 11/1996 |
| NO | 313183 | | 4/2002 |
| NO | 313273 | | 8/2002 |
| WO | WO02/03638 | * | 4/2002 |
| WO | WO 02/30638 | | 4/2002 |
| WO | WO02/060660 | * | 8/2002 |
| WO | WO 02/060660 | | 8/2002 |

OTHER PUBLICATIONS

Office Action EPO of Nov. 22, 2007.

* cited by examiner

*Primary Examiner*—Leszek Kiliman
(74) *Attorney, Agent, or Firm*—Christian Abel

(57) ABSTRACT

A furan polymer impregnated wood which comprises wood impregnated with a polymerizable furfuryl alcohol monomer mixture containing at least furfuryl alcohol, stabilizing co-solvent water, and an initiator selected from the group consisting of anhydrides, acids and combinations thereof is described. A method for preparing a furan impregnated wood and uses thereof is also described.

8 Claims, No Drawings

FURAN POLYMER IMPREGNATED WOOD

The invention described herein relates to a furan polymer impregnated wood which is uniform in colour and density throughout the treated zone. In order to obtain the polymer impregnated wood, a parent wood has been impregnated with a polymerizable furfuryl alcohol monomer mixture containing at least water, furfuryl alcohol, a low boiling point organic co-solvent and at least one initiator. The invention also relates to a method for preparing a furan impregnated wood and uses thereof.

Furfuryl alcohol polymerizes (resinifies) in acid media. The acid initiates the polymerization reaction. Strong acids cause violent polymerization of limited usefulness because of the violence. But using weak acids, such as organic acids, the polymerization reaction can be controlled. When it is desired to use furfuryl alcohol as an impregnant for porous materials like wood, it has been found that it is important to select a weak acid that does not separate from the furfuryl alcohol as it moves into the porous media. Having a weak acid that has chemical affinity with the wood is also useful. The non-separating mixture with enhanced affinity for wood is the basis of WO 02/30638.

For some uses, it is desirable to impregnate porous materials like wood with less initiated furfuryl alcohol than in WO 02/30638. It has been found that lower concentrations of furfuryl alcohol polymer (also named furan polymer or furan resin) in the wood still provide useful properties at lower cost and less change in appearance. Wood prepared according to WO 02/30638 is very dark colored. With lower concentrations, colours from light tan to dark brown are possible.

A method of controlling the concentration of furan polymer in the porous material is to use a liquid carrier for the initiated furfuryl alcohol. The carrier and furfuryl alcohol are impregnated into the porous material together. The carrier is removed from the porous material after impregnation, leaving the initiated furfuryl alcohol in place within the porous material. Polymerization of the initiated furfuryl alcohol can occur before, during or after extraction of the inert carrier. Wood and wood materials are the principle objects of this invention, but other porous materials like brick, Portland cement concrete and stone could be similarly impregnated.

Water is an environmentally friendly, inexpensive compound. Furfuryl alcohol is soluble in water, so water can be used as a carrier for diluted, uninitiated furfuryl alcohol but it will not polymerize usefully.

When an organic acid initiator is mixed with furfuryl alcohol, an ester is formed. That ester has limited solubility in water. A two-phase mixture occurs. Upon agitation, an emulsion is formed. In early work with this mixture, it was assumed that the emulsion would not penetrate wood well, so experiments were conducted exploring ways to cause the mixture to become a single phase. Those experiments showed that adding certain chemicals produced a stabilized, single phase mixture with the catalyzed furfuryl alcohol and water which is the basis of WO 02/060660. The first useful chemicals stabilizers discovered were borax and sodium salts of lignosulfonic acids.

Another mode of creating stable solutions without the use of the stabilizers mentioned above is to use low boiling point organic co-solvents. Such co-solvents are methanol, ethanol and acetone. These co-solvents are both good solvents of furfuryl alcohol and good swelling agents for wood. These co-solvents keep the pH value up during storage and impregnation, thereby prolonging the useful service life of the treating solutions, and when they are removed from the impregnated wood before curing the pH goes down as the co-solvent is evaporated from the wood. An effective co-solvent removal step has to be added to the treatment process. This removal step is preferably a vacuum drying process with a system for recovery of the co-solvent, so that the co-solvent can be reused. By the use of organic co-solvents, there is no need for added stabilizers and the initiator: FA ratio can be reduced. This leads to lower amounts of leachable substances in the resulting wood product.

Organic co-solvents maintained the pH of useful treating mixtures until after the wood was impregnated. Then the pH decreased (became more acid) which facilitated curing.

One object of the invention is to provide a furan polymer impregnated wood by altering the wood cell wall with the same chemical monomer as that disclosed in WO 02/30638 but using smaller amounts of chemical.

Another object of the invention is to provide a furan polymer impregnated wood having improved properties such as dimensional stability, decay and weather resistance.

According to the present invention, the foregoing and other objects are attained by a product, method and uses thereof as disclosed in the patent claims.

In one embodiment of this invention, there is provided a furan polymer impregnated wood, characterized by wood impregnated with a polymerizable furfuryl alcohol monomer mixture containing at least water, furfuryl alcohol, an organic co-solvent selected from acetone or a low-temperature boiling alcohol such as methanol, ethanol or isopropanol and combinations thereof, and an initiator selected from maleic anhydride, phthalic anhydride, maleic acid, malic acid, phthalic acid, benzoic acid, citric acid, zinc chloride, aluminum chloride, other cyclic organic anhydrides and acids and combinations thereof.

It is noted that said low boiling point organic co-solvent can be used alone or in combination with at least another co-solvent so long as solubility of the initiated FA is maintained. The same applies for said initiator.

In another embodiment of this invention, there is provided a method for preparing a furan polymer impregnated wood, characterized in that the wood is impregnated by one impregnation step with polymerizable furfuryl alcohol monomer mixture containing at least furfuryl alcohol, an organic co-solvent selected from acetone or a low-temperature boiling alcohol such as methanol, ethanol or isopropanol and combinations thereof, water, and at least an initiator selected from maleic anhydride, phthalic anhydride, maleic acid, malic acid, phthalic acid, benzoic acid, citric acid, zinc chloride, aluminum chloride, other cyclic organic anhydrides and acids and combinations thereof, followed by a curing step.

Any use of the furan polymer impregnated wood can be provided. However, use as building parts (fascia, cornice, siding, sills, frames, millwork), boat parts (frames, planking, decks), marine items (docks, piers, lobster traps, weir poles), outdoor items (furniture, decks, railings and stairs, walkways, boardwalks, playground equipment), bridge parts (beams, railings, decking), railway sleepers, cooling tower slats, utility poles, heavy timbers, fenceposts, stakes, highway items (guard rail posts, guard rail plates, sign posts, light poles), flooring and containers (tanks, buckets) is preferred.

The key to the invention is the use of an organic co-solvent as a diluent for catalyzed furfuryl alcohol monomer, which allows the initiated monomer to be water soluble and remain stable in storage.

The co-solvents and initiators have similar affinity for wood as furfliryl alcohol and therefore enter the wood and remain in solution as deeply as it penetrates. Wherever the solution penetrates, it is polymerizable. The initiators are selected from any water-soluble, organic, anhydride-containing compound as well as acids including maleic acid, malic acid, phthalic acid, citric acid and benzoic acid. However, preferably a compound selected from maleic anhydride, phthalic anhydride, citric acid and combinations thereof is used. More preferably, maleic anhydride or phthalic anhydride in combination with citric acid is used, most preferably combinations of all of the three compounds maleic anhydride, phthalic anhydride and citric acid is used. The organic co-solvents include acetone and organic alcohols with low boiling point and high vapour pressure, preferably alcohols such as methanol, ethanol and isopropyl alcohol, and most preferably methanol or ethanol.

If limited surface impregnation or end-grain penetration is needed, brushing, rolling, spraying or soaking using the impregnating mixture can be used.

For easily impregnable woods, when deep penetration is not needed, vacuum only may be used. For deep and uniform penetration, there are three options: a) pressure alone (1 to 10 bar), b) vacuum followed by pressure (full cell process), c) atmospheric or low (1 bar) pressure followed by pressure and then final vacuum (empty-cell process).

For difficult-to-penetrate woods like spruce, an oscillating pressure method may be used.

Times required for all of these processes depend upon many factors, including capability of equipment, size of wood, species of wood and penetration desired.

The impregnation method generally used (full cell process) in accordance with the present invention is as follows:

i) loading vessel with wood and securing the load so it will not float
ii) closing door and drawing an appropriate partial vacuum,
iii) filling the vessel with the treating mixture, while maintaining vacuum,
iv) pressurizing the submerged wood to a pressure in the range of 5 to 14 bar (75 to 210 psi) depending on wood species and other factors,
v) after sufficient time under pressure, reducing pressure to 2 or 3 bar, and expelling the treating fluid with remaining pressure,
vi) releasing all pressure, opening door and removing treated wood to curing area.

Wood moisture content must be below fiber saturation point (about 30% MC) in the zone to be treated. The lower the moisture content, the more chemical that can be impregnated. If a specific target amount of chemical is required, the moisture content of the wood and the amount of mixture impregnated must be taken into account and the concentration of the treating chemical adjusted accordingly.

The following examples are presented in further illustration of the invention and are not to be construed as limiting the scope of the invention.

Examples of formulations of treating mixture we have successfully tried are given in table 1. In these formulations, 50-84 wt-% of the solution is co-solvent+water.

TABLE 1

Formulations of different treating solutions using stabilizing co-solvents

| | Treating formulation (wt- % of total solution) | | | | | | | |
|---|---|---|---|---|---|---|---|---|
| CHEMICAL | No. 1 | No. 2 | No. 3 | No. 4 | No. 5 | No. 6 | No. 7 | No. 8 |
| Furfuryl alcohol (FA) | 22.5 | 22.5 | 22.5 | 21.5 | 15.00 | 30.0 | 47.50 | — |
| Maleic anhydride (MA) | — | — | 0.5 | 1.2 | 0.30 | 0.4 | 0.44 | — |
| Phthalic anhydride (PA) | 0.5 | 0.5 | — | — | 0.15 | 0.2 | 0.22 | — |
| Citric acid | — | 1.0 | 1.0 | — | 0.80 | 1.2 | 1.50 | — |
| Maleic acid | 1.0 | — | — | — | — | — | — | — |
| Boric acid | — | — | — | 0.1 | — | — | — | — |
| Kraft lignin | — | — | — | 2.5 | — | — | — | — |
| Ethanol | 71.0 | 71.0 | 71.0 | 55.1 | 39.80 | 34.1 | — | — |
| Methanol | — | — | — | — | 39.80 | 30.0 | 47.00 | — |
| Triethanol amine | — | — | — | — | 0.10 | 0.1 | 0.04 | — |
| Water | 5.0 | 5.0 | 5.0 | 19.6 | 4.05 | 4.0 | 3.30 | 100 |
| Total | 100.0 | 100.0 | 100.0 | 100.0 | 100.0 | 100.0 | 100.0 | 100 |
| Liquid uptake (% m/m) in pine sapwood, 5 × 5 × 25 cm | 117 | 125 | 124 | n.a. | 125 | 134 | 134 | 136 |
| Liquid uptake (l/m$^3$) in pine sapwood, 5 × 5 × 25 cm | 681 | 725 | 723 | n.a. | 731 | 712 | 698 | 680 |
| Liquid uptake (l/m$^3$) in beech wood, 4 × 8 × 45 cm | 615 | 623 | 667 | n.a. | n.a. | 687 | 648 | 630 |

All other concentrations of furfuryl alcohol in co-solvent/water (from about 5% to nearly 100% based on solution) with proportional amounts of initiator and buffer can be used, depending on the desired product polymer loading and material properties. Below about 5% there is too little polymer formed in the wood to change properties usefully, and approaching 100% the properties become very close to WO 02/30638.

The effect on some physical and mechanical properties of wood by varying the different treatment solution components is given in tables 2 and 3.

The yield (% of theoretical value) of monomer conversion to polymer in the wood actually increases with the degree of dilution (80% yield at 15% FA-conc). It should be added that the evaporation of co-solvent was done by vacuum drying in the case of formulations no 5-7. Vacuum drying leads to higher yields than conventional drying at low temperatures as were the case for no 1-4. Anti swelling efficiency (ASE) in the third wetting-drying cycle (each cycle consisting of 5 days immersion in water followed by two days of drying) was remarkably high, even at quite low weight percent gain (WPG). However, moisture exclusion efficiency (MEE) was much lower than for high WPGs as would be the case for wood treated according to NO-A-20005137. In a modified EN84 leaching cycle where the modification consists of the use of methanol in stead of water during the first week of leaching, the total weight loss due to leaching of treated wood is equal to or less than the total weight loss for untreated wood. This indicates that the wood product is filled with polymer and not leachable substances and that the use of co-solvent is not interfering with the polymerization of FA.

TABLE 2

Effect of treating formulation on some properties of Scots pine (*Pinus sylvestris*) sapwood

| Measured Property | Unit | Treating formulation No. 1 | No. 2 | No. 3 | No. 4 | No. 5 | No. 6 | No. 7 | Untreated Control |
|---|---|---|---|---|---|---|---|---|---|
| WPG | % | 20 | 17 | 20 | 30 | 15 | 32 | 44 | — |
| Yield | % of theoret. | 67 | 53 | 62 | n.a. | 80 | 74 | 67 | — |
| $ASE_3$ | % | 56 | 48 | n.a. | 31 | 37 | 55 | 71 | 0 |
| $MEE_3$ | % | 17 | 8 | n.a. | 36 | n.a. | n.a. | n.a. | 0 |
| Weight loss (3 ASE-cycles) | wt- % | 2.2 | 3.4 | n.a. | 2.1 | 3.0 | 2.5 | 1.2 | 1.9 |
| Weight loss (modified[a] EN84) | wt- % | n.a. | n.a. | n.a. | n.a. | 2.4 | 1.7 | 0.6 | 2.4 |
| Acetone extractable | wt- % in Soxhlet extraction | 3.4 | 3.8 | 3.2 | n.a. | n.a. | n.a. | n.a. | 1.5 |
| Impact strength | $kJ/m^2$ | 9.3 | 10.1 | 10.3 | n.a. | 12.0 | 7.0 | 6.6 | 16.0 |

[a]Leached one week in methanol followed by one week in water instead of leaching two weeks in water

TABLE 3

Effect of treating formulation on strength properties of Scots pine sapwood

| Treating solution | WPG (%) | MOR[a] (MPa) | st.dev | MOE[b] (GPa) | st.dev | Hardness[c] (HB) ($kp/mm^2$) | st.dev | Impact strength[d] ($kJ/m^2$) | st.dev. |
|---|---|---|---|---|---|---|---|---|---|
| None | 0 | 91.8 ± 9.5 | | 15.5 ± 1.7 | | 4.20 ± 0.56 | | 16.0 ± 2.8 | |
| 5 | 15 | 103.1 ± 5.6 | | 16.7 ± 1.6 | | 4.59 ± 0.32 | | 12.0 ± 1.6 | |
| 6 | 32 | 94.6 ± 14.2 | | 16.3 ± 1.5 | | 4.86 ± 0.29 | | 7.0 ± 1.0 | |
| 7 | 47 | 97.4 ± 13.1 | | 16.3 ± 2.1 | | 4.94 ± 0.26 | | 6.6 ± 1.1 | |

[a]Bending strength ($\sigma_b$) in 4-point bending according to EN 408:1995
[b]Modulus of elasticity in 4-point bending according to EN 408:1995
[c]Brinell hardness according to EN 1534
[d]Charpy Impact strength according to ASTM D4508:1993

Table 3 shows that the hardness, bending strength and modulus of elasticity is slightly increased by the treatment whereas the impact strength is decreased. However, at high levels of FA-dilution (using treating formulation number 5) the decrease in impact strength due to treatment is minor.

Decay Resistance

The weight loss values (in tab 4) for each fungus and both species allows the treated wood to be classified as 'resistant' to 'highly resistant' to decay according to EN 113.

TABLE 4

Decay test results in pure fungal culture bioassays

| Treating formulat. | WPG (after curing) Pine | Beech | EN 113 Average weight loss (%) *Poria placenta* Pine (*Pinus sylv.*) | *Coriolus versicolor* Beech (*Fagus sylvatica*) | *Coniophora puteana* Pine | Beech | ENV 807 (soft rot) Weight loss (%) Pine | Beech |
|---|---|---|---|---|---|---|---|---|
| None | 0 | 0 | 27 | 22 | 35 | 28 | 15 | 12 |
| 5 | 15 | 22 | — | 4 | 2 | 7 | 1 | 3 |
| 6 | 34 | 30 | 1 | 3 | 1 | 0 | — | 1 |
| 7 | 53 | 57 | 0 | — | — | — | 0 | — |

The weight loss values due to decay in TMCs (terrestrial microcosms) as shown in table 5 gives an even clearer indication of high resistance to microbial decay. Furthermore, the TMC-tests are more realistic than the EN113 test.

TABLE 5

Decay test results in Terrestrial microcosms (soil box testing)

| Treating formulat. | WPG (after curing) of pine sapwood | Weight loss during pre-leaching (%) | Weight loss in TMC 1 (Compost soil) 6 months exposure WL (%) | st.dev. | Weight loss in TMC 2 (Simlångsdalen soil) 6 months exposure WL (%) | st.dev. | Weight loss in TMC 3 (Conifer forest soil) 12 months exposure WL (%) | st.dev. |
|---|---|---|---|---|---|---|---|---|
| none | untreated | 2.35 | 61.75 | ± 7.85 | 61.21 | ± 1.24 | 20.12 | ± 1.96 |
| 5 | 22 | 2.41 | 1.65 | ± 0.29 | 2.92 | ± 1.03 | 8.54 | ± 0.53 |
| 6 | 41 | 1.69 | 0.98 | ± 0.23 | 1.84 | ± 0.15 | 4.99 | ± 0.74 |
| 7 | 60 | 0.57 | 0.70 | ± 0.25 | 1.59 | ± 0.30 | 1.89 | ± 0.38 |
| none | untreated | n.a. | 35.8 | | 33.0 | | 16.0 | |
| 4 | 30 | n.a. | 1.4 | | 1.6 | | 1.7 | |

Mixtures of about 9% to 90% concentration of furfuryl alcohol based on solution were found to provide moisture and decay protection to the wood, with the higher concentrations performing better. However, the lower concentrations improve properties, making them attractive for uses for which untreated wood deteriorates. These lower concentrations are of especial interest because of their low cost and light color. But to protect the full concentration range expected to be practical and useful, the following water-based mixture percentage (based on solution) limits are suggested:

| Furfuryl alcohol | | Initiator | | Stabilizing co-solvent | |
|---|---|---|---|---|---|
| Lower | Upper | Lower | Upper | Lower | Upper |
| 2 | 90 | 1 | 5 | 0 | 95 |

Treatment Process

The mixing operation is usually started by heating the water to approximately 40° C. which facilitates the addition of maleic or citric acid. When these solid additives are fully dissolved in the water, the solution is cooled to 20° C. to 25° C. Secondly, maleic and phthalic anhydride is dissolved in the furfuryl alcohol under stirring (initialization of the FA), the cooled weak acid is also added to the FA, the solution is diluted by co-solvent (methanol and/or ethanol) and is stored at a temperature of 15° C. to 20° C. Alternatively, all the other ingredients can be added directly to the co-solvent during stirring. However, this cannot practically be carried out at elevated temperature because polymerization can occur in the mixture.

The impregnation step will be performed as described before.

The vacuum drying step will be performed at room temperature and temperature raised to approx 40° C. during the final phase of the drying. The heating media in the vacuum oven could be warm water tubing. The vacuum oven should be equipped with a total condensor for recovery of co-solvent.

The curing can take place at a range of temperatures, starting at from about 25° C. to about 140° C. The lower temperatures (below about 40° C.) require a long time to cure (days or weeks). From about 70° C. to about 100° C. the curing time is hours. Above 100° C. curing times are even shorter but usually moisture conditions must be controlled because otherwise rapid drying can occur causing checking and cracking of the wood.

In accordance with the present invention, steam or hot, humid air curing in the temperature range of about 70° C. to 100° C. works well at a fixed temperature within the range. Also, temperature can be increased as curing and drying proceeds. Essentially, this is conventional temperature kiln drying. Curing and drying in hot oil also works well at temperatures from 70° C. to 120° C., either a fixed temperature within the range or by increasing temperature within the range as curing and drying proceeds. Curing and drying in controlled humidity with fixed or increasing temperature in the 100° C. to 120° C. range works well. Essentially, this is high-temperature kiln drying. The furfuryl alcohol will cure readily in these temperatures with the furfuryl initiator to alcohol ratio used. Material 10 mm to 20 mm thick will cure in two or three hours, but drying to final moisture content takes longer.

The Wood

The starting material is a woody material, usually lumber, which includes plank (thick lumber), but can also be wood composites such as oriented strand board and particleboard. Woody materials of any dimensions can be utilized.

The length of the woody materials is important to treating times and impregnation uniformity since the treating mixture travels very quickly along the length but very slowly across the grain (perpendicular to the tree axis). With permeable woods like beech and birch, the uniformity of treatment is determined by how well the treating mixture remains uniform as it travels along the length, and moves from pores to fibers. When impregnation of permeable wood is complete, the woody material formed by this method has uniform properties throughout. Colour, mechanical properties and resistance to moisture, weathering and deterioration are consistent throughout. Different species of wood, and even different boards of the same species, may impregnate differently because of differences in permeability. This is inherent in the nature of wood. With woods of low permeability, impregnation along the grain is slow and the across-the-grain direction may be the major path for impregnation.

In that case, the treating mixture, and resulting properties, remain uniform as deeply as the mixture penetrates.

Woody material, including cheap types and scrap material, can be used to produce noble wood products such as imitation teak, mahogany, and others, and also provide them with novel properties like water and weather resistance and simpler and reduced maintenance requirements.

The invention claimed is:

1. A furan polymer impregnated wood, characterized by wood impregnated with a polymerizable furfuryl alcohol monomer mixture containing at least water, furfuryl alcohol, an organic co-solvent selected from acetone or a low-temperature boiling alcohol such as methanol, ethanol or isopropanol and combinations thereof, and an initiator selected from maleic anhydride, phthalic anhydride and other cyclic organic anhydrides, maleic acid, malic acid, phthalic acid, benzoic acid, citric acid and other acids and combinations thereof, zinc chloride, and aluminum chloride.

2. A method for preparing a furan polymer impregnated wood, comprising the steps of (a) impregnating the wood by one impregnation step with polymerizable furfuryl alcohol monomer mixture containing at least furfuryl alcohol, an organic co-solvent selected from acetone or a low-temperature boiling alcohol such as methanol, ethanol or isopropanol and combinations thereof, water, and at least one initiator selected from maleic anhydride, phthalic anhydride and other cyclic organic anhydrides, maleic acid, malic acid, phthalic acid, benzoic acid, citric acid and other acids and combinations thereof, zinc chloride, and aluminum chloride, (b) evaporating the co-solvent at room temperature such that the pH of the mixture is reduced, C) recovering the co-solvent for re-use, and C) curing the wood.

3. The method of claim 2, wherein the co-solvent is evaporated under vacuum.

4. The method of claim 2, characterized in that said curing is performed co-solvent is evaporated by maintaining approximately room temperature for some days or weeks.

5. The method of claim 2, characterized in that said curing is performed by use of a temperature in the range of from about 70° C. to about 140° C.

6. The method of claim 2, characterized in that said curing requires conventional kiln drying using the normal temperature schedules for drying untreated, green lumber of the same size and species as the impregnated material, with temperatures at the beginning of curing about 45° C. and at the end about 90° C., with a final post-curing step between 100° C. to 140° C. for material with maximum hardness and dryness.

7. The method of claim 2, characterized in that said curing and drying can be accomplished using high-temperature kiln schedules in the 80° C. to 120° C. temperature range with a possible final post-curing step between 120° C. to 140° C. for material with maximum hardness and dryness.

8. The method of claim 2, characterized in that curing is performed by submerging the treated material in hot oil, preferably 80° C. to 120° C., with the temperature either fixed or stalling lower in the range and increasing as curing and drying proceeds.

* * * * *